US010794380B2

(12) United States Patent
Sakai et al.

(10) Patent No.: US 10,794,380 B2
(45) Date of Patent: Oct. 6, 2020

(54) PUMP DEVICE

(71) Applicant: KYB Corporation, Tokyo (JP)

(72) Inventors: Yuki Sakai, Kanagawa (JP); Tetsuya Iwanaji, Kanagawa (JP)

(73) Assignee: KYB CORPORATION, Tokyo (JP)

( * ) Notice: Subject to any disclaimer, the term of this patent is extended or adjusted under 35 U.S.C. 154(b) by 0 days.

(21) Appl. No.: 16/307,275

(22) PCT Filed: May 23, 2017

(86) PCT No.: PCT/JP2017/019283
§ 371 (c)(1),
(2) Date: Dec. 5, 2018

(87) PCT Pub. No.: WO2017/212918
PCT Pub. Date: Dec. 14, 2017

(65) Prior Publication Data

US 2019/0301445 A1 Oct. 3, 2019

(30) Foreign Application Priority Data

Jun. 8, 2016 (JP) ..... 2016-114425

(51) Int. Cl.
*F04B 49/20* (2006.01)
*F04B 49/12* (2006.01)
(Continued)

(52) U.S. Cl.
CPC ..... *F04B 49/20* (2013.01); *F04B 49/12* (2013.01); *F04B 49/22* (2013.01); *F15B 11/00* (2013.01);
(Continued)

(58) Field of Classification Search
CPC ..... F15B 11/05; F15B 2211/20576; F15B 2211/20553
See application file for complete search history.

(56) References Cited

U.S. PATENT DOCUMENTS 5,447,027 A * 9/1995 Ishikawa ..... E02F 9/2225 60/420
6,105,367 A * 8/2000 Tsuruga ..... E02F 9/2225 60/422
(Continued)

FOREIGN PATENT DOCUMENTS

JP H06-300002 A 10/1994
JP H11-293710 A 10/1999
(Continued)

*Primary Examiner* — Thomas E Lazo
(74) *Attorney, Agent, or Firm* — Rabin & Berdo, P.C.

(57) ABSTRACT

A pump device includes a variable capacity first pump, a tilt actuator that controls a tilt angle of a swash plate of the first pump in accordance with the control pressure, a regulator that regulates the control pressure in accordance with a front-rear differential pressure of a control valve, a fixed capacity second pump driven by the same drive source as the first pump, the control actuator that operates in accordance with the front-rear differential pressure a resistor so as to drive the regulator to reduce the control pressure in response to an increase in the front-rear differential pressure of the resistor, an auxiliary passage that leads an auxiliary pressure to the control actuator, the auxiliary pressure acting on the control actuator against a upstream pressure of the resistor, and a switch valve that switches between connecting and shutoff the auxiliary passage.

8 Claims, 2 Drawing Sheets

(51) Int. Cl.

| | |
|---|---|
| ***F04B 49/22*** | (2006.01) |
| ***F15B 11/05*** | (2006.01) |
| ***F15B 11/00*** | (2006.01) |
| ***F15B 11/02*** | (2006.01) |

(52) U.S. Cl.
CPC ..... *F15B 11/02* (2013.01); *F15B 11/05* (2013.01); *F05B 2260/98* (2013.01); *F05B 2270/327* (2013.01)

(56) References Cited

U.S. PATENT DOCUMENTS

| | | | | |
|---|---|---|---|---|
| 6,564,548 | B2 * | 5/2003 | Nishimura | B66C 13/18 60/431 |
| 6,651,428 | B2 * | 11/2003 | Takahashi | E02F 9/2203 60/447 |
| 8,726,648 | B2 * | 5/2014 | Sato | E02F 9/2235 60/431 |
| 9,080,311 | B2 * | 7/2015 | Yoshida | F02D 41/029 |
| 2003/0097836 | A1 | 5/2003 | Takahashi et al. | |
| 2016/0003237 | A1 | 1/2016 | Aoyama | |

FOREIGN PATENT DOCUMENTS

| | | | |
|---|---|---|---|
| JP | 2001-323902 | A | 11/2001 |
| JP | 2010-230133 | A | 10/2010 |
| WO | WO-2014/156532 | A1 | 10/2014 |

* cited by examiner

PUMP DEVICE

TECHNICAL FIELD

The present invention relates to a pump device.

BACKGROUND ART

JP1994-300002A discloses a hydraulic circuit structure for a construction machine, having a hydraulically driven actuator and a variable capacity hydraulic pump that supplies pressure oil to the actuator, wherein load control is executed to vary a pump discharge amount of the hydraulic pump in accordance with a workload of the actuator.

SUMMARY OF INVENTION

A pump device subjected to load control (load sensing control), such as that disclosed in JP1994-300002A, can control the speed of a drive actuator in accordance with an opening of a control valve, irrespective of the workload of the drive actuator, by discharging a working fluid at a discharge flow corresponding to the workload.

However, the required speed of the drive actuator, or in other words the required supply flow from the pump device, may differ from operator to operator, for example, even when the opening of the control valve remains the same.

Hence, there is demand for a load-controlled pump device with which the supply flow (the discharge flow) from the pump device can be modified as desired, even when the workload remains the same.

An object of the present invention is to modify a discharge flow of a load-controlled pump device, irrespective of the workload.

According to one aspect of the present invention, a pump device for supplying a working fluid to a drive actuator for driving a drive subject through a control valve, includes: a variable capacity first pump configured to supply the working fluid to the drive actuator, the first pump having a discharge capacity that varies in accordance with a tilt angle of a swash plate; a tilt actuator configured to control the tilt angle of the swash plate of the first pump in accordance with a control pressure supplied thereto; a regulator configured to regulate the control pressure in accordance with a front-rear differential pressure of the control valve; a fixed capacity second pump configured to be driven by an identical drive source to that of the first pump; a resistor provided in a pump passage through which the working fluid discharged from the second pump is led; a control actuator configured to operate in accordance with a front-rear differential pressure of the resistor so as to drive the regulator to reduce the control pressure in response to an increase in the front-rear differential pressure of the resistor; an auxiliary passage configured to lead an auxiliary pressure to the control actuator, the auxiliary pressure acting on the control actuator against either an upstream side pressure or a downstream side pressure of the resistor; and a switch valve configured to switch between a state in which the auxiliary pressure is supplied to the control actuator through the auxiliary passage and a state in which the auxiliary pressure is shut off.

DESCRIPTION OF EMBODIMENTS

Referring to the figures, a pump device 100 according to an embodiment of the present invention and a hydraulic driving device 1 that includes the pump device 100 will be described.

Figure 1:
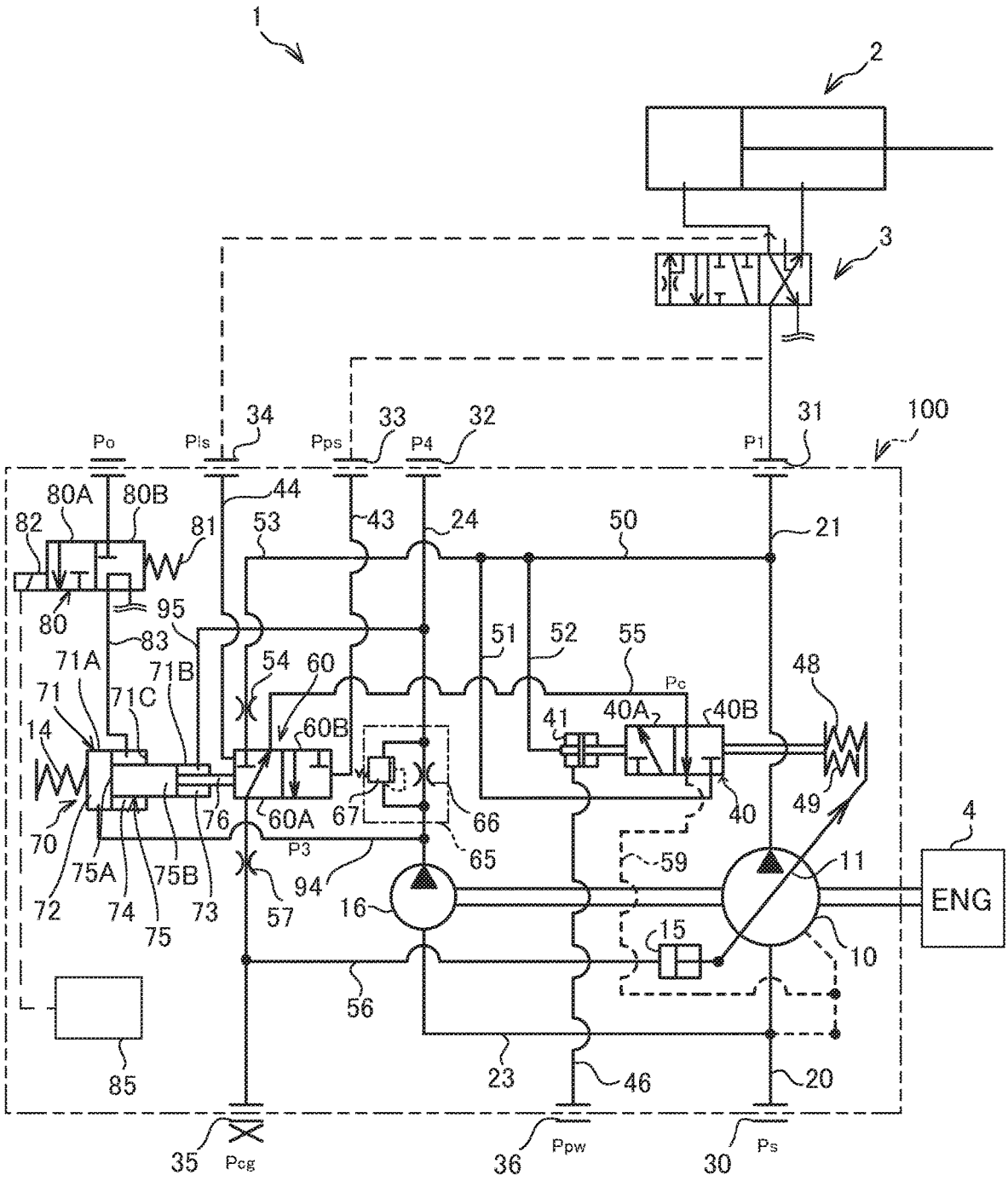
FIG. 1 is a circuit diagram showing a hydraulic circuit of a hydraulic driving device including a pump device according to an embodiment of the present invention.

The hydraulic driving device 1 is installed in a hydraulic shovel, for example, in order to drive a drive subject (a boom, an arm, a bucket, or the like). As shown in FIG. 1, the hydraulic driving device 1 includes a hydraulic cylinder 2 serving as a drive actuator that drives the drive subject in accordance with the supply and discharge of working oil, which serves as a working fluid, thereto and therefrom, a control valve 3 that controls a flow of the working oil supplied to and discharged from the hydraulic cylinder 2, and the pump device 100, which serves as a driving oil pressure source for supplying the working oil to the hydraulic cylinder 2 through the control valve 3.

The hydraulic cylinder 2 drives the drive subject by expanding and contracting in response to the working oil that is led thereto from the pump device 100 through the control valve 3. An opening of the control valve 3 is adjusted in response to an operation performed by an operator, whereby the control valve 3 adjusts a flow of the working oil supplied to the hydraulic cylinder 2. In FIG. 1, only one hydraulic cylinder 2 and the control valve 3 for controlling the hydraulic cylinder 2 are shown, and other drive actuators and control valves have been omitted.

The working oil discharged from the pump device 100 is pumped to a pump port 31 through a discharge passage 21, and then led to the hydraulic cylinder 2 through the control valve 3, which is connected to the pump port 31.

The pump device 100 includes a variable capacity first pump 10 for supplying working oil to the hydraulic cylinder 2, a discharge capacity of the first pump 10 being varied in accordance with a tilt angle of a swash plate 11, a tilt actuator 15 that controls the tilt angle of the swash plate 11 of the first pump 10 in accordance with a control pressure Pcg supplied thereto, a regulator (a load sensing regulator) 60 that regulates the control pressure Pcg led to the tilt actuator 15 in accordance with a front-rear differential pressure of the control valve 3, and a horsepower control regulator 40 that regulates a control source pressure Pc led to the regulator 60 in accordance with a discharge pressure P1 of the first pump 10.

A swash plate piston pump, for example, is used as the first pump 10, and the discharge capacity (a pump displacement volume) thereof is adjusted in accordance with the tilt angle of the swash plate 11. It should be noted that the "discharge capacity" denotes an amount of working oil discharged by the first pump 10 per revolution. Further, a "discharge flow", to be described below, denotes an amount of working oil discharged by the first pump 10 and a second pump 16, to be described below, per unit time.

The first pump 10 is driven by an engine 4 serving as a drive source. The first pump 10 suctions working oil through a suction passage 20 from a tank port 30 connected to a tank (not shown), and discharges the working oil, which is pressurized by a piston (not shown) that reciprocates while following the swash plate 11, into the discharge passage 21. The working oil discharged from the first pump 10 is supplied to the hydraulic cylinder 2 through the control valve 3. Further, a part of the working oil discharged from the first pump 10 is led to a branch passage 50 that bifurcates from the discharge passage 21. The branch passage 50 bifurcates into first to third discharge pressure passages 51, 52, 53, and leads the discharge pressure P1 of the first pump 10 into each thereof.

The first pump 10 includes a cylinder block (not shown) that is driven to rotate by the engine 4, the piston, which reciprocates through a cylinder in the cylinder block so as to discharge the suctioned working oil, the swash plate 11, which is followed by the piston, and horsepower control springs 48, 49 that bias the swash plate 11 in a direction for increasing the tilt angle thereof.

The tilt actuator 15 drives the swash plate 11 against a biasing force of the horsepower control springs 48, 49 of the first pump 10. When the tilt angle of the swash plate 11 is varied by an operation of the tilt actuator 15, a stroke length of the piston that reciprocates while following the swash plate 11 varies, leading to variation in the discharge capacity of the first pump 10. The tilt actuator 15 may be built into the cylinder block of the first pump 10 or provided on the exterior of the cylinder block.

When the control pressure Pcg regulated by the horsepower control regulator 40 and the regulator 60 increases, the tilt actuator 15 executes an expansion operation so as to reduce the tilt angle of the swash plate 11, and as a result, the discharge capacity of the first pump 10 decreases.

The horsepower control regulator 40 is a switch valve having three ports and two positions. A first control pressure passage 55 connected to the regulator 60 is connected to a port on one side of the horsepower control regulator 40. The first discharge pressure passage 51 to which the discharge pressure P1 of the first pump 10 is led and a low pressure passage 59 connected to the tank are connected respectively to two ports on the other side of the horsepower control regulator 40.

The horsepower control regulator 40 includes a spool (not shown) that moves continuously between a high pressure position 40A in which the first control pressure passage 55 communicates with the first discharge pressure passage 51, and a low pressure position 40B in which the first control pressure passage 55 communicates with the low pressure passage 59. The biasing force of the horsepower control springs 48, 49 is applied to one end of the spool of the horsepower control regulator 40. The discharge pressure P1 of the first pump 10, which is led through the second discharge pressure passage 52, acts on the other end of the spool. The spool of the horsepower control regulator 40 moves to a position where the discharge pressure P1 and the biasing force of the horsepower control springs 48, 49 are counterbalanced, thereby varying respective openings of the high pressure position 40A and the low pressure position 40B.

The horsepower control springs 48, 49 are coupled to the spool of the horsepower control regulator 40 at one end, and linked to the swash plate 11 of the first pump 10 at the other end. The horsepower control spring 49 is formed to be shorter than the horsepower control spring 48. The biasing force generated by the horsepower control springs 48, 49 varies according to the tilt angle of the swash plate 11 and the position of the spool of the horsepower control regulator 40. Hence, the biasing force exerted on the swash plate 11 from the horsepower control springs 48, 49 increases in steps in accordance with the tilt angle of the swash plate 11 and the stroke of the spool of the horsepower control regulator 40.

The horsepower control regulator 40 is provided with a horsepower control actuator 41. The horsepower control actuator 41 operates in accordance with a horsepower control signal pressure Ppw that is led thereto from a horsepower control signal pressure port 36 through a horsepower control signal pressure passage 46.

A control system of the hydraulic shovel is switched between a high load mode and a low load mode. The horsepower control signal pressure Ppw is reduced in the high load mode and increased in the low load mode. When the horsepower control signal pressure Ppw is increased in the low load mode, the spool of the horsepower control regulator 40 moves in a direction for switching to the high pressure position 40A. Accordingly, the control source pressure Pc increases, leading to a reduction in the load of the first pump 10.

The regulator 60 is a switch valve having three ports and two positions. The third discharge pressure passage 53 to which the discharge pressure P1 of the first pump 10 is led and the first control pressure passage 55 connected to the horsepower control regulator 40 are connected respectively to two ports on one side of the regulator 60. A second control pressure passage 56 that leads the control pressure Pcg to the tilt actuator 15 is connected to a port on the other side of the regulator 60. A throttle 57 is interposed in the second control pressure passage 56, and pressure variation in the control pressure Pcg led to the tilt actuator 15 is mitigated by the throttle 57. Further, a throttle 54 is interposed in the third discharge pressure passage 53, and pressure variation in the discharge pressure P1 led to the regulator 60 is mitigated by the throttle 54.

The regulator 60 includes a spool (not shown) that moves continuously between a first position 60A in which the first control pressure passage 55 communicates with the second control pressure passage 56, and a second position 60B in which the third discharge pressure passage 53 communicates with the second control pressure passage 56.

An upstream signal pressure Pps generated on an upstream side of the control valve 3 on the basis of the discharge pressure P1 of the first pump 10 is led to one end of the spool of the regulator 60 from a signal port 33 through a first signal passage 43. A downstream signal pressure Pls generated on a downstream side of the control valve 3 on the basis of a load pressure of the hydraulic cylinder 2 is led to another end of the spool of the regulator 60 from a signal port 34 through a second signal passage 44. Further, a biasing force of an LS spring 14 that biases the regulator 60 in a direction for switching to the first position 60A is exerted on the other end of the spool of the regulator 60.

The pump device 100 also includes the second pump 16, which is a fixed capacity pump and is driven by the same drive source as the first pump 10, a resistor 65 interposed in a pump passage 24 through which the working oil discharged from the second pump 16 is led, a control actuator 70 that adjusts the control pressure Pcg by driving the regulator 60 in accordance with a front-rear differential pressure (P3−P4) of the resistor 65, an auxiliary passage 83 that leads an auxiliary pressure Po, which acts against a pressure P3 on an upstream side of the resistor 65, to the control actuator 70, a switch valve 80 that is provided in the auxiliary passage 83 so as to selectively switch between connecting and shutting off the auxiliary passage 83, and a controller 85 that switches the switch valve 80 in accordance with operation input from an operator.

The second pump 16 is provided side by side with the first pump 10, and is driven by the engine 4 together with the first pump 10. A gear pump, for example, is used as the second pump 16, The second pump 16 suctions working oil through a branch suction passage 23 bifurcating from the suction passage 20, and discharges the pressurized working oil into the pump passage 24. The working oil discharged from the second pump 16 is pumped to a pump port 32 through the pump passage 24, and supplied to a hydraulic driving unit or the like for switching the control valve 3 through a passage (not shown) connected to the pump port 32.

The resistor 65 includes a fixed throttle 66 and a relief valve 67 that are interposed parallel to each other in the pump passage 24. When the pressure P3 on the upstream side of the resistor 65 exceeds a predetermined value (a relief pressure), the relief valve 67 opens. As a result, the working oil discharged from the second pump 16 passes through both the fixed throttle 66 and the relief valve 67.

The control actuator 70 includes a cylinder 71, a piston 75 that slides freely through the interior of the cylinder 71, and a rod 76 that is coupled to the piston 75 and linked to the regulator 60.

The cylinder 71 includes a first cylinder portion 71A, a second cylinder portion 71B having a smaller inner diameter than the first cylinder portion 71A, and an annular step portion 71C formed between the first cylinder portion 71A and the second cylinder portion 71B.

The piston 75 includes a first piston portion 75A inserted into the first cylinder portion 71A to be free to slide, and a second piston portion 75B inserted into the second cylinder portion 71B to be free to slide, the second piston portion 75B being connected to the first piston portion 75A and the rod 76 being coupled thereto.

The interior of the cylinder 71 is partitioned by the piston 75 into a first pressure chamber 72 formed between the first piston portion 75A and a bottom portion of the first cylinder portion 71A, a second pressure chamber 73 formed on an outer periphery of the rod 76 between the second piston portion 75B and a bottom portion of the second cylinder portion 71B, and a third pressure chamber 74 formed between the first piston portion 75A and the step portion 71C of the cylinder 71.

The pressure (referred to hereafter as the "upstream pressure") P3 on the upstream side of the resistor 65 is led to the first pressure chamber 72 through an upstream pressure passage 94. The upstream pressure P3 led to the first pressure chamber 72 acts on the first piston portion 75A of the piston 75 so as to generate a driving force for moving the rod 76 in a direction (a rightward direction in FIG. 1) for switching the regulator 60 to the first position 60A.

The pressure (referred to hereafter as the "downstream pressure") P4 on the downstream side of the resistor 65 is led to the second pressure chamber 73 through a downstream pressure passage 95. The downstream pressure P4 led to the second pressure chamber 73 acts on the second piston portion 75B of the piston 75 so as to generate a driving force for moving the rod 76 in a direction (a leftward direction in FIG. 1) for switching the regulator 60 to the second position 60B.

The auxiliary passage 83 communicates with the third pressure chamber 74 so as to lead the auxiliary pressure Po, which is supplied from the exterior of the pump device 100, into the third pressure chamber 74. The auxiliary pressure Po is generated by, for example, adjusting the pressure of the working oil discharged from the second pump 16 using an adjustment mechanism provided on the exterior of the pump device 100.

The auxiliary pressure Po led into the third pressure chamber 74 acts on the first piston portion 75A of the piston 75 from an opposite side to the upstream pressure P3 so as to resist the upstream pressure P3, and thereby generates a driving force for moving the rod 76 in the leftward direction of the figure. Hence, in addition to the upstream pressure P3 and the downstream pressure P4 of the resistor 65, which act on the control actuator 70 in mutually opposite directions, or in other words the front-rear differential pressure (P3−P4) of the resistor 65, the auxiliary pressure Po acts on the control actuator 70 against the upstream pressure P3.

The switch valve 80 is a solenoid switch valve (an ON-OFF valve) having two ports and two positions. The switch valve 80 has a communication position 80A for connecting the auxiliary passage 83 so as to supply the auxiliary pressure Po to the third pressure chamber 74, and a shutoff position 80B for shutting off supply of the auxiliary pressure Po to the third pressure chamber 74 through the auxiliary passage 83. In the shutoff position 80B, the third pressure chamber 74 communicates with the tank. The switch valve 80 includes a spool (not shown) that is switched selectively between the communication position 80A and the shutoff position 80B, a biasing spring 81 for biasing the spool to take the shutoff position 80B, and a solenoid 82 that is energized so as to generate driving force against the biasing force of the biasing spring 81.

The switch valve 80 is provided separately to the regulator 60. In so doing, the layout freedom of the switch valve 80 and the auxiliary passage 83 relative to the regulator 60 can be improved. As a result, lowering of the driving force of the solenoid 82 due to an influence of a gravitational force caused by arranging the solenoid 82 along the vertical direction can be prevented.

The controller 85 is constituted by a microcomputer having a CPU (a central processing unit), a ROM (a read-only memory), a RAM (a random access memory), and an I/O interface (an input/output interface). The RAM stores data used during processing executed by the CPU. A control program of the CPU and so on are stored in the ROM in advance. The I/O interface is used to input and output information into and from devices connected thereto. The controller 85 may be constituted by a plurality of microcomputers. The controller 85 is programmed to be capable of at least executing processing required to implement control according to this embodiment and modified examples thereof. It should be noted that the controller 85 may be constituted by a single device, or divided into a plurality of devices such that the processing of this embodiment is executed discretely by the plurality of devices.

When a current is supplied to the solenoid 82 from the controller 85, the switch valve 80 takes the communication position 80A, whereby the auxiliary passage 83 opens. As a result, the auxiliary pressure Po is led into the third pressure chamber 74 of the control actuator 70 through the auxiliary passage 83.

Conversely, when energization of the solenoid 82 from the controller 85 is shut off, the switch valve 80 is caused to take the shutoff position 80B by the biasing force of the biasing spring 81, whereby the auxiliary passage 83 is shut off. As a result, supply of the auxiliary pressure Po to the third pressure chamber 74 is shut off, and the third pressure chamber 74 communicates with the tank so as to shift to a tank pressure.

The auxiliary pressure Po is led selectively to the control actuator 70 from the auxiliary passage 83 in addition the front-rear differential pressure (P3–P4) of the resistor 65, and therefore the spool moves to a position where the front-rear differential pressure (P3–P4) of the resistor 65 and the auxiliary pressure Po are counterbalanced. In accordance therewith, the control actuator 70 exerts a driving force on the regulator 60. In other words, the front-rear differential pressure (P3–P4) of the resistor 65 and the auxiliary pressure Po act on the spool of the regulator 60 as the driving force exerted from the control actuator 70 in addition to an LS differential pressure (Pps-Pls) generated on the front and the rear of the control valve 3, and the biasing force of the LS spring 14 that acts on the other end of the spool. As a result, the spool of the regulator 60 moves to a position where the LS differential pressure (Pps-Pls), the front-rear differential pressure (P3–P4) of the resistor 65, the auxiliary pressure Po, and the biasing force of the LS spring 14 are counterbalanced, thereby varying the respective openings of the first position 60A and the second position 60B of the regulator 60.

Next, referring to FIGS. 1 and 2, actions of the pump device 100 will be described.

In the pump device 100, horsepower control for controlling the discharge capacity of the first pump 10 so as to maintain the discharge pressure P1 of the first pump 10 at a constant pressure is executed by the horsepower control regulator 40, load control (LS control) for controlling the discharge capacity of the first pump 10 so as to maintain the front-rear differential pressure (the LS differential pressure) of the control valve 3 at a constant pressure is executed by the regulator 60, and discharge flow control for controlling the discharge capacity of the first pump 10 in accordance with a pump rotation speed (an engine rotation speed) is executed.

In the pump device 100, the regulator 60 regulates the control pressure Pcg in accordance with the control source pressure Pc, which is regulated by the horsepower control regulator 40. Hence, in a condition where the discharge pressure P1 of the first pump 10 is maintained within a fixed range, the discharge capacity of the first pump 10 is controlled by load control rather than horsepower control. When the discharge pressure P1 exceeds the fixed range, the discharge capacity of the first pump 10 is controlled by horsepower control. Thus, the discharge capacity of the first pump 10 can be controlled by horsepower control to maintain the discharge pressure P1 of the first pump 10 within the fixed range, and at the same time, the discharge capacity of the first pump 10 can also be controlled by load control to maintain the LS differential pressure of the control valve 3 at a constant pressure.

The respective types of control will now be described more specifically.

First, the horsepower control executed by the horsepower control regulator 40 will be described.

When the discharge pressure P1 of the first pump 10 increases in response to an increase in the pump rotation speed such that the driving force generated by the discharge pressure P1 received by the spool of the horsepower control regulator 40 increases beyond the biasing force of the horsepower control springs 48, 49, the spool moves in the direction (the rightward direction in FIG. 1) for switching to the high pressure position 40A. Accordingly, a communication opening (a communication flow passage area) between the first control pressure passage 55 and the first discharge pressure passage 51 increases, and as a result, the control source pressure Pc in the first control pressure passage 55 is increased by the discharge pressure P1 of the first pump 10, which is led through the first discharge pressure passage 55. When the control source pressure Pc led to the regulator 60 increases, the control pressure Pcg regulated by the regulator 60 increases, and as a result, the tilt actuator 15 drives the swash plate 11 of the first pump 10 such that the tilt angle thereof decreases. Hence, when the discharge pressure P1 of the first pump 10 increases, the discharge capacity of the first pump 10 decreases.

Conversely, when the discharge pressure P1 of the first pump 10 decreases in response to a reduction in the pump rotation speed such that the driving force generated by the discharge pressure P1 received by the spool of the horsepower control regulator 40 falls below the biasing force of the horsepower control springs 48, 49, the spool moves in the direction (the leftward direction in FIG. 1) for switching to the low pressure position 40B. Accordingly, the communication opening between the first control pressure passage 55 and the low pressure passage 59 increases, and as a result, the control source pressure Pc in the first control pressure passage 55 is reduced by the pressure in the low pressure passage 59 communicating with the tank. As a result, the control pressure Pcg regulated by the regulator 60 also decreases, whereby the tilt angle of the swash plate 11 is increased by the biasing force of the horsepower control springs 48, 49. Hence, when the discharge pressure P1 of the first pump 10 decreases, the discharge capacity of the first pump 10 increases.

As described above, the horsepower control regulator 40 regulates the control source pressure Pc led to the regulator 60 so that the driving force generated by the discharge pressure P1 and the biasing force of the horsepower control springs 48, 49 are counterbalanced. The horsepower control regulator 40 operates to increase the control pressure Pcg by increasing the control source pressure Pc in accordance with an increase in the discharge pressure P1 resulting from an increase in the pump rotation speed, and in so doing, reduces the discharge capacity of the first pump 10. Further, the horsepower control regulator 40 operates to reduce the control pressure Pcg by reducing the control source pressure Pc in accordance with a reduction in the discharge pressure P1 resulting from a reduction in the pump rotation speed, and in so doing, increases the discharge capacity of the first pump 10. In other words, when the pump rotation speed varies, the horsepower control regulator 40 varies the discharge capacity of the first pump 10 so as to cancel out variation in the discharge flow (the supply flow) of the first pump 10 resulting from the variation in the pump rotation speed. As a result, a load (a work rate) of the first pump 10 is regulated so as to remain substantially constant, irrespective of the pump rotation speed.

Next, the load control executed by the regulator 60 will be described.

When a load of the hydraulic cylinder 2 increases, the downstream signal pressure (a load pressure) Pls led to the signal port 34 from the downstream side (a load side) of the control valve 3 increases. When the LS differential pressure (Pps–Pls) decreases in response to the increase in the downstream signal pressure Pls, the spool of the regulator 60 is moved by the biasing force of the LS spring 14 in the direction for switching to the first position 60A.

When the spool of the regulator 60 moves in the direction for switching to the first position 60A, the communication opening between the first control pressure passage 55 and the second control pressure passage 56 increases. Accordingly, the control pressure Pcg led to the tilt actuator 15 decreases on the basis of the control source pressure Pc, which is regulated by the horsepower control regulator 40 to be lower than the discharge pressure P1 of the first pump 10. As a result, the tilt actuator 15 moves in a direction (the leftward direction in FIG. 1) for increasing the tilt angle of the swash plate 11, leading to an increase in the discharge capacity of the first pump 10. When the discharge capacity of the first pump 10 increases, the discharge flow (the supply flow) of the first pump 10 also increases, leading to an increase in the LS differential pressure (Pps−Pls) of the control valve 3.

Conversely, when the load of the hydraulic cylinder 2 decreases, the downstream signal pressure (the load pressure) Pls decreases. When the LS differential pressure (Pps−Pls) increases in response to the reduction in the downstream signal pressure Pls, the spool of the regulator 60 is moved against the biasing force of the LS spring 14 in the direction for switching to the second position 60B.

When the spool of the regulator 60 moves in the direction for switching to the second position 60B, the communication opening between the third discharge pressure passage 53 and the second control pressure passage 56 increases. Accordingly, the control pressure Pcg increases on the basis of the discharge pressure P1 of the first pump 10, which is led through the third discharge pressure passage 53. As a result, the tilt actuator 15 moves in a direction (the rightward direction in FIG. 1) for reducing the tilt angle of the swash plate 11, leading to a reduction in the discharge capacity of the first pump 10. When the discharge capacity of the first pump 10 decreases, the discharge flow (the supply flow) of the first pump 10 also decreases, leading to a reduction in the LS differential pressure (Pps−Pls) of the control valve 3.

Hence, the regulator 60 regulates the control pressure Pcg led to the tilt actuator 15 so that the LS differential pressure (Pps−Pls) and the biasing force of the LS spring 14 are counterbalanced. When the LS differential pressure (Pps−Pls) decreases, the regulator 60 operates to increase the LS differential pressure (Pps−Pls) by reducing the control pressure Pcg so as to increase the discharge capacity of the first pump 10. Further, when the LS differential pressure (Pps−Pls) increases, the regulator 60 operates to reduce the LS differential pressure (Pps−Pls) by increasing the control pressure Pcg so as to reduce the discharge capacity of the first pump 10. In other words, the regulator 60 controls the discharge capacity of the first pump 10 so that even when the load of the hydraulic cylinder 2 varies, the LS differential pressure (Pps−Pls) remains substantially constant.

Hence, as long as the opening (the position) of the control valve 3 remains constant, the hydraulic cylinder 2 can be driven at a constant speed, irrespective of the workload, and as a result, an improvement in the controllability of the hydraulic cylinder 2 can be achieved. In other words, a drive speed (the supply flow) of the hydraulic cylinder 2 can be controlled in accordance with the opening (the position) of the control valve 3 alone, and as a result, variation in the speed of the hydraulic cylinder 2 caused by variation in the workload can be prevented.

Next, discharge flow control based on the pump rotation speed will be described.

The discharge flow control is executed by driving the regulator 60 using the control actuator 70 in accordance with the front-rear differential pressure (P3−P4) of the resistor 65 to which the working oil discharged from the second pump 16 is led.

First, a condition in which the pump rotation speed (the engine rotation speed) is lower than a predetermined pump rotation speed N1 (see FIG. 2) and the upstream pressure P3 of the resistor 65 is lower than the relief pressure of the relief valve 67 (i.e., a condition in which the relief valve 67 is closed) will be described.

When the pump rotation speed (the engine rotation speed) decreases, the discharge flow of the second pump 16 decreases, leading to a reduction in the front-rear differential pressure (P3−P4) of the resistor 65. When the pump rotation speed decreases while the relief valve 67 is closed, leading to a reduction in the front-rear differential pressure (P3−P4) of the resistor 65, or in other words a relative increase in the downstream pressure P4 of the resistor 65, from a condition in which the force acting on the control actuator 70 is counterbalanced, the control actuator 70 moves in the direction (the leftward direction in FIG. 1) for switching the regulator 60 to the second position 60B. Accordingly, the communication opening between the third discharge pressure passage 53 and the second control pressure passage 56 increases such that the control pressure Pcg increases on the basis of the discharge pressure P1 of the first pump 10, which is led through the third discharge pressure passage 53. As a result, the tilt actuator 15 drives the swash plate 11 of the first pump 10 so as to reduce the tilt angle thereof, leading to a reduction in the discharge capacity of the first pump 10.

Conversely, when the pump rotation speed increases, the discharge flow of the second pump 16 increases, leading to an increase in the front-rear differential pressure (P3−P4) of the resistor 65. When the front-rear differential pressure (P3−P4) of the resistor 65 increases, or in other words when a relative increase occurs in the upstream pressure P3, from a condition in which the force acting on the control actuator 70 is counterbalanced, the control actuator 70 drives the spool of the regulator 60 in the direction (the rightward direction in FIG. 1) for switching to the first position 60A. Accordingly, the communication opening between the first control pressure passage 55 and the second control pressure passage 56 increases such that the control pressure Pcg led to the tilt actuator 15 decreases on the basis of the control source pressure Pc, which is regulated by the horsepower control regulator 40. As a result, the tilt actuator 15 drives the swash plate 11 of the first pump 10 so as to increase the tilt angle thereof, leading to an increase in the discharge capacity of the first pump 10.

Figure 2:
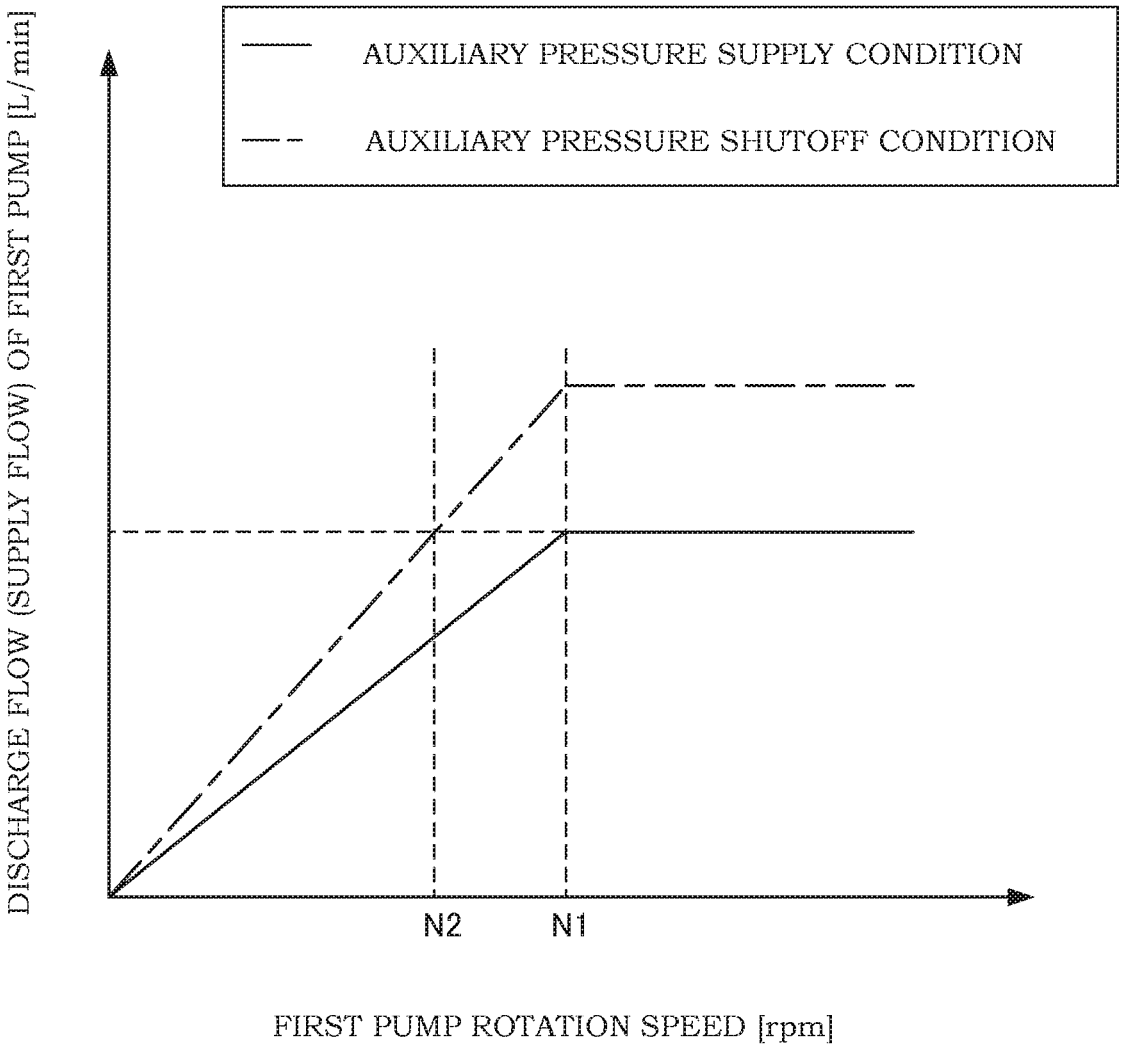
FIG. 2 is a diagram illustrating discharge flow control executed on the pump device according to this embodiment of the present invention, the diagram taking the form of a graph showing a relationship between a pump rotation speed and a discharge flow.

As described above, in a condition where the relief valve 67 is not open, the discharge flow of the first pump 10 is controlled to increase in proportion with an increase in the engine rotation speed, as shown in FIG. 2.

When the upstream pressure P3 of the resistor 65 reaches or exceeds the relief pressure of the relief valve 67 in response to an increase in the discharge pressure of the second pump 16 accompanying an increase in the pump rotation speed, the relief valve 67 provided in parallel with the fixed throttle 66 opens. As a result, the working oil discharged from the second pump 16 passes through both the fixed throttle 66 and the relief valve 67. Accordingly, a flow passage area of the resistor 65 increases, leading to a reduction in a resistance exerted on the flow of working oil, and as a result, a rate at which the front-rear differential pressure of the resistor 65 varies relative to the increase in the pump rotation speed decreases.

When the rate at which the front-rear differential pressure of the resistor 65 varies relative to the increase in the pump rotation speed decreases, a rate at which the discharge flow of the first pump 10 increases relative to the increase in the pump rotation speed (i.e., a gain) also decreases. Hence, as shown in FIG. 2, for example, the discharge flow of the first pump 10 can be set at a substantially constant flow without increasing even when the pump rotation speed increases further from the pump rotation speed N1 at which the relief valve 67 opens. As a result, by providing the resistor 65 with the relief valve 67, the rate at which the discharge flow of the first pump 10 increases can be modified.

Next, actions of the auxiliary passage 83 and the switch valve 80 will be described. In the following description, a condition in which the switch valve 80 is in the communication position 80A so that the auxiliary pressure Po is led into the third pressure chamber 74 of the control actuator 70 through the auxiliary passage 83 will be referred to as an "auxiliary pressure supply condition", and a condition in which, conversely, the switch valve 80 is in the shutoff position 80B so that the auxiliary pressure Po is not led (i.e. is shut off) into the third pressure chamber 74 will be referred to as an "auxiliary pressure shutoff condition".

The auxiliary pressure Po led through the auxiliary passage 83 is supplied to the third pressure chamber 74 of the control actuator 70 in order to generate driving force for resisting the upstream pressure P3 of the resistor 65 with respect to the piston 75 and the rod 76 of the control actuator 70. In other words, the auxiliary pressure Po acts on the piston 75 and the rod 76 of the control actuator 70 so as to supplement the downstream pressure P4 of the resistor 65, and therefore apparently acts to reduce the front-rear differential pressure (P3–P4) of the resistor 65. Hence, in the auxiliary pressure supply condition, the rod 76 of the control actuator 70 is positioned further along in a compression direction than in the auxiliary pressure shutoff condition such that in the regulator 60, the opening of the second position 60B increases. Accordingly, when the auxiliary pressure Po is led to the control actuator 70, the communication opening between the third discharge pressure passage 53 and the second control pressure passage 56, which communicate with each other in the second position 60B of the regulator 60, increases.

In the auxiliary pressure supply condition, therefore, the control pressure Pcg led to the tilt actuator 15 increases such that, as shown in FIG. 2, the discharge flow of the first pump 10 is smaller than in the auxiliary pressure shutoff condition at an identical pump rotation speed. Conversely, in the auxiliary pressure shutoff condition, the control pressure Pcg is smaller than in the auxiliary pressure supply condition, and as a result, the discharge flow of the first pump 10 increases.

In the pump device 100, when the operator presses an operating switch (not shown) and the controller 85 detects operation input, a current is either supplied from the controller 85 to the solenoid 82 or shut off such that the position of the switch valve 80 switches. As a result, the auxiliary pressure Po is either led to the control actuator 70 or shut off.

Here, as described above, the load-controlled pump device 100 controls the discharge capacity of the first pump 10 in accordance with the LS differential pressure of the control valve 3 (the workload of the hydraulic cylinder 2), and therefore the speed of the hydraulic cylinder 2 is controlled in accordance with the opening of the control valve 3 alone, irrespective of the workload. In other words, when the pump rotation speed (the engine rotation speed) and the workload are constant, the discharge capacity of the first pump 10 of the pump device 100 is also constant.

In a hydraulic shovel, the required speed of the hydraulic cylinder 2 may differ according to the experience level and so on, for example, of the operator steering the shovel. For example, an operator with a comparatively low level of experience may require a lower driving speed than an experienced operator, even at an identical workload.

With the pump device 100, however, the discharge capacity of the first pump 10 can be modified while keeping the workload and the pump rotation speed constant by switching the switch valve 80 to either lead the auxiliary pressure Po to the control actuator 70 or shut the auxiliary pressure Po off.

More specifically, when the hydraulic cylinder 2 is to be driven comparatively slowly, the discharge capacity of the first pump 10 can be made comparatively small by switching the switch valve 80 to the communication position 80A so that the auxiliary pressure Po is led to the control actuator 70. In so doing, the flow of the working oil supplied to the hydraulic cylinder 2 can be reduced, and as a result, the hydraulic cylinder 2 can be driven comparatively slowly.

Conversely, when the hydraulic cylinder 2 is to be driven comparatively quickly, the discharge capacity of the first pump 10 can be made comparatively large by switching the switch valve 80 to the shutoff position 80B so that supply of the auxiliary pressure Po to the control actuator 70 is shut off. In so doing, the flow of the working oil supplied to the hydraulic cylinder 2 can be increased, and as a result, the hydraulic cylinder 2 can be driven comparatively quickly.

By switching the switch valve 80 in this manner, the control pressure Pcg can be varied irrespective of the workload, and as a result, the amount of control exerted by the tilt actuator 15 on the tilt angle of the first pump 10 can be varied. Hence, in the load-controlled pump device 100, a drive speed corresponding to requirements can be realized in the hydraulic cylinder 2 by modifying the discharge flow, irrespective of the workload.

Next, modified examples of this embodiment will be described. The following modified examples are within the scope of the present invention, and configurations of the modified examples may be combined with the respective configurations described in the above embodiment. Moreover, the modified examples to be described below may be combined with each other.

In the above embodiment, the controller 85 switches the position of the switch valve 80 in response to operation input from the operator. In another configuration, the controller 85 may switch the position of the switch valve 80 and modify the rotation speed of the engine 4 in response to operation input from the operator.

More specifically, the controller 85 switches an operation of the pump device 100 between two control conditions, namely a "normal mode" and an "energy saving mode", by varying the engine rotation speed in accordance with the switch executed on the switch valve 80 on the basis of operation input from the operator.

In the normal mode, the engine rotation speed is maintained at a relatively high speed, and the switch valve 80 is switched to the communication position 80A. At this time, the pump rotation speed is set at the first rotation speed N1 (see FIG. 2), for example. In the normal mode, the auxiliary pressure Po is led to the control actuator 70 so that the discharge capacity of the first pump 10 is set to be relatively small.

In the energy-saving mode, the controller 85 maintains the engine rotation speed at a lower speed than in the normal mode (at this time, the pump rotation speed is set at a "second rotation speed N2") and switches the switch valve 80 to the shutoff position 80B so that supply of the auxiliary pressure Po to the control actuator 70 is shut off. Hence, in the energy-saving mode, supply of the auxiliary pressure Po to the control actuator 70 is shut off so that the discharge capacity of the first pump 10 remains relatively high, whereby a reduction in the discharge flow of the first pump 10 caused by the reduction in the engine rotation speed is canceled out. As a result, the supply flow to the hydraulic cylinder 2 can be maintained at an approximately identical flow to the normal mode. In other words, when the normal mode is switched to the energy-saving mode, although the pump rotation speed decreases from the first rotation speed N1 to the second rotation speed N2, the discharge capacity of the first pump 10 increases, and therefore the discharge flow of the first pump 10 does not vary.

Hence, in the energy-saving mode, as shown in FIG. 2, an identical discharge flow (supply flow) to that of the normal mode can be secured even though the pump rotation speed is lower than in the normal mode, and therefore an equal driving speed to that of the normal mode can be realized. As a result, the energy consumption of the pump device 100 can be suppressed.

Conversely, in the normal mode, the rate at which the discharge flow varies relative to the pump rotation speed is smaller than in the energy-saving mode, and therefore the discharge flow can be adjusted easily by modifying the engine rotation speed. Hence, in the normal mode, the supply flow to the hydraulic cylinder 2 can be adjusted with a high degree of precision.

Further, in the above embodiment, the auxiliary pressure Po acts against the upstream pressure P3 of the resistor 65, thereby acting apparently to reduce the front-rear differential pressure (P3−P4) of the resistor 65. Instead, however, the auxiliary pressure Po may act against the downstream pressure P4 of the resistor 65, or in other words act to supplement the upstream pressure P3, thereby acting apparently to increase the front-rear differential pressure (P3−P4). Likewise in this case, by switching between supplying and shutting off the auxiliary pressure Po using the switch valve 80, the control pressure Pcg regulated by the regulator 60 can be varied, and as a result, the discharge flow of the first pump 10 can be varied while the load remains constant.

Further, in a case where the position of the switch valve 80 is switched and the rotation speed of the engine 4 is modified, the present invention is not limited to the configuration of the modified example described above, in which the rotation speed of the engine 4 is reduced and supply of the auxiliary pressure Po that acts against the upstream pressure P3 of the resistor 65 is shut off, and another configuration may be employed. More specifically, on the basis of operation input from the operator, the rotation speed of the engine 4 may be increased or reduced, the auxiliary pressure Po may be set to act against the upstream pressure P3 or the downstream pressure P4 of the resistor 65, and the auxiliary pressure Po may be supplied or shut off when the rotation speed of the engine 4 varies (increases or decreases). Moreover, these configurations may be combined as desired. For example, the pump device 100 may be configured such that when the rotation speed of the engine 4 decreases, the auxiliary pressure Po is supplied against the downstream pressure P4 of the resistor 65. In this case, identical actions and effects to those of the energy-saving mode described above are obtained. Hence, variation in the rotation speed of the engine 4, switching of the auxiliary pressure Po, and the direction in which the auxiliary pressure Po acts may be set as desired in accordance with requirements.

Furthermore, in the above embodiment, the resistor 65 includes the relief valve 67 provided in parallel with the fixed throttle 66, but the present invention is not limited thereto, and the relief valve 67 may be omitted. Alternatively, the relief valve 67 may be provided on the exterior of the pump device 100.

Further, in the above embodiment, the switch valve 80 is an ON-OFF valve for selectively switching between connecting and shutting off the auxiliary passage 83. Instead, however, the switch valve 80 may be a proportional solenoid valve that controls the magnitude of the auxiliary pressure Po led to the control actuator 70 by opening the auxiliary passage 83 by a communication opening (a communication flow passage area) corresponding to an energization amount applied to the solenoid 82. In this case, for example, the controller 85 may obtain the engine rotation speed and energize the solenoid 82 of the switch valve 80 by an energization amount corresponding to the engine rotation speed. By configuring the pump device 100 in this manner, the speed of the hydraulic cylinder 2 can be controlled in accordance with variation in the engine rotation speed.

According to the embodiments described above, following effects are obtained.

In the pump device 100, by switching between connecting and shutting off the auxiliary passage 83 using the switch valve 80, the auxiliary pressure Po is switched between being led to the control actuator 70 and being shut off. By switching between supplying the auxiliary pressure Po to the control actuator 70 and shutting the auxiliary pressure Po off, an expansion/contraction position of the control actuator 70 is varied, leading to variation in the amount by which the control actuator 70 drives the regulator 60. Accordingly, the control pressure Pcg, which is regulated by the regulator 60, varies. Hence, by switching the switch valve 80, the control pressure Pcg can be varied irrespective of the workload, and as a result, the amount by which the tilt actuator 15 controls the tilt angle of the first pump 10 can be varied. In the load-controlled pump device 100, therefore, a driving speed corresponding to requirements can be realized in the hydraulic cylinder 2 by modifying the discharge flow, irrespective of the workload.

Moreover, the pump device 100 is switched between the normal mode, in which the engine rotation speed is maintained at comparatively high rotation, and the energy-saving mode, in which the engine rotation speed is maintained at comparatively low rotation, in accordance with operation input from the operator. In the energy-saving mode, the auxiliary passage 83 is shut off, and therefore the control actuator 70 drives the swash plate 11 of the first pump 10 so as to increase the tilt angle thereof. Hence, in the energy-saving mode, an identical discharge flow (supply flow) to that of the normal mode can be secured even though the pump rotation speed is lower than in the normal mode, whereby an equal driving speed to that of the normal mode can be realized. As a result, the energy consumption of the pump device 100 can be suppressed.

The configurations, actions, and effects of the embodiments of the present invention are summarized below.

The pump device 100 that supplies the working oil to the hydraulic cylinder 2 for driving the drive subject through the control valve 3 includes the variable capacity first pump 10 that supplies the working oil to the hydraulic cylinder 2 and has a discharge capacity that varies in accordance with the tilt angle of the swash plate 11, the tilt actuator 15 that controls the tilt angle of the swash plate 11 of the first pump 10 in accordance with the control pressure Pcg supplied thereto, the regulator 60 that regulates the control pressure Pcg in accordance with the front-rear differential pressure (the LS differential pressure) of the control valve 3, the fixed capacity second pump 16 driven by the same drive source (the engine 4) as the first pump 10, the resistor 65 provided in the pump passage 24 through which the working oil discharged from the second pump 16 is led, the control actuator 70 that operates in accordance with the front-rear differential pressure (P3–P4) of the resistor 65 so as to drive the regulator 60 to reduce the control pressure Pcg in response to an increase in the front-rear differential pressure (P3–P4) of the resistor 65, the auxiliary passage 83 that leads the auxiliary pressure Po to the control actuator 70, the auxiliary pressure Po acting on the control actuator 70 against either the upstream pressure P3 or the downstream pressure P4 of the resistor 65, and the switch valve 80 that is switched between a state in which the auxiliary pressure Po is supplied to the control actuator 70 through the auxiliary passage 83 and a state in which the auxiliary pressure Po is shut off.

According to this configuration, by switching between connecting and shutting off the auxiliary passage 83 using the switch valve 80, the auxiliary pressure Po is switched between being led to the control actuator 70 and being shut off. By switching between supplying the auxiliary pressure Po to the control actuator 70 and shutting the auxiliary pressure Po off, the movement amount of the control actuator 70 is varied, leading to variation in the amount by which the control actuator 70 drives the regulator 60. Accordingly, the control pressure Pcg, which is regulated by the regulator 60, varies. Hence, by switching the switch valve 80, the control pressure Pcg can be varied irrespective of the workload, and as a result, the amount by which the tilt actuator 15 controls the tilt angle of the first pump 10 can be varied. In the load-controlled pump device 100, therefore, the discharge flow can be modified irrespective of the workload.

Moreover, the pump device 100 further includes the horsepower control regulator 40 that varies the control pressure Pcg supplied to the tilt actuator 15 in accordance with the discharge pressure P1 of the first pump 10, and the regulator 60 regulates the control pressure Pcg supplied to the tilt actuator 15 in accordance with the control source pressure Pc regulated by the horsepower control regulator 40.

According to this configuration, when the discharge pressure P1 of the first pump 10 varies, the horsepower control regulator 40 varies the control pressure Pcg regulated by the regulator 60 by regulating the control source pressure Pc led to the regulator 60. As a result, the load (the work rate) of the first pump 10 can be regulated so as to remain within a predetermined range, irrespective of the pump rotation speed.

Furthermore, the pump device 100 further includes the controller 85 that can switch the switch valve 80 and modify the rotation speed of the drive source (the engine 4) in accordance with operation input from the operator.

According to this configuration, the switch valve 80 is switched at a desired timing of the operator, and therefore the discharge capacity of the first pump 10 can be modified in accordance with the requirements of the operator.

Further, in the pump device 100, the controller 85 increases the discharge capacity of the first pump 10 by switching the switch valve 80 so as to shut off the auxiliary passage 83 and reducing the rotation speed of the drive source (the engine 4) in accordance with operation input from the operator.

According to this configuration, the discharge capacity of the first pump 10 increases together with a reduction in the rotation speed of the drive source (the engine 4), and therefore the discharge flow of the first pump 10 (the supply flow to the hydraulic cylinder 2) can be maintained without decreasing. Hence, even when the rotation speed of the drive source (the engine 4) decreases, a reduction in the driving speed of the hydraulic cylinder 2 can be prevented, and as a result, the energy consumption of the first pump 10 can be suppressed.

Moreover, in the pump device 100, the resistor 65 includes the fixed throttle 66 that applies resistance to the flow of working oil discharged from the second pump 16, and the relief valve 67 that is provided in parallel with the fixed throttle 66 and opens when the upstream pressure P3 of the resistor 65 exceeds a predetermined value.

According to this configuration, when the upstream pressure P3 rises to or above the relief pressure of the relief valve 67 in response to an increase in the pump rotation speed, the relief valve 67 opens. Accordingly, the working oil discharged from the second pump 16 passes through both the fixed throttle 66 and the relief valve 67, leading to an increase in the flow passage area of the resistor 65, and as a result, the rate at which the front-rear differential pressure (P3–P4) of the resistor 65 varies in response to the increase in the pump rotation speed decreases. Hence, by providing the resistor 65 with the relief valve 67, the rate at which the discharge flow of the first pump 10 increases relative to the pump rotation speed can be modified.

Embodiments of this invention were described above, but the above embodiments are merely examples of applications of this invention, and the technical scope of this invention is not limited to the specific constitutions of the above embodiments.

This application claims priority based on Japanese Patent Application No. 2016-114425 filed with the Japan Patent Office on Jun. 8, 2016, the entire contents of which are incorporated into this specification.

The invention claimed is:

1. A pump device for supplying a working fluid to a drive actuator for driving a drive subject through a control valve, comprising:

a variable capacity first pump configured to supply the working fluid to the drive actuator, the first pump having a discharge capacity that varies in accordance with a tilt angle of a swash plate;

a tilt actuator configured to control the tilt angle of the swash plate of the first pump in accordance with a control pressure supplied thereto;

a first regulator configured to regulate the control pressure in accordance with a front-rear differential pressure of the control valve;

a fixed capacity second pump configured to be driven by a drive source that drives the first pump;

a resistor provided in a pump passage through which the working fluid discharged from the second pump is led;

a control actuator configured to operate in accordance with a front-rear differential pressure of the resistor so as to drive the first regulator to reduce the control pressure in response to an increase in the front-rear differential pressure of the resistor;

an auxiliary passage configured to lead an auxiliary pressure to the control actuator independently from other flow of the working fluid led to the control actuator, the auxiliary pressure acting on the control actuator against either an upstream side pressure or a downstream side pressure of the resistor; and a switch valve configured to switch between a state in which the auxiliary pressure is supplied to the control actuator through the auxiliary passage and a state in which the auxiliary pressure is shut off.

2. The pump device according to claim 1, further comprising a horsepower control second regulator configured to vary the control pressure supplied to the tilt actuator in accordance with a discharge pressure of the first pump, wherein the first regulator is configured to regulate the control pressure supplied to the tilt actuator in accordance with a control source pressure that is regulated by the horsepower control second regulator.

3. The pump device according to claim 1, further comprising a controller configured to switch the switch valve and modify a rotation speed of the drive source in accordance with operation input from an operator.

4. The pump device according to claim 1, wherein the auxiliary passage is configured to lead the auxiliary pressure, which is supplied from an exterior of the pump device, to the control actuator, and the switch valve is provided in the auxiliary passage.

5. The pump device according to claim 1, wherein the control actuator comprises:

a cylinder;

a piston configured to move so as to slide freely through an interior of the cylinder; and a rod coupled to the piston and linked to the first regulator, and a first pressure chamber into which the upstream side pressure of the resistor is led, a second pressure chamber into which the downstream side pressure of the resistor is led, and a third pressure chamber into which the auxiliary pressure is led from the auxiliary passage are provided in the interior of the cylinder.

6. The pump device according to claim 1, wherein the auxiliary passage configured to lead the auxiliary pressure to the control actuator independently from both the upstream side pressure and the downstream side pressure, the front-rear differential pressure of the resistor is obtained by difference between the upstream side pressure and the downstream side pressure that are led to the control actuator, the upstream side pressure being led through the pump passage of an upstream side of the resistor, the downstream side pressure being led through the pump passage of a downstream side of the resistor.

7. A pump device for supplying a working fluid to a drive actuator for driving a drive subject through a control valve, comprising:

a variable capacity first pump configured to supply the working fluid to the drive actuator, the first pump having a discharge capacity that varies in accordance with a tilt angle of a swash plate;

a tilt actuator configured to control the tilt angle of the swash plate of the first pump in accordance with a control pressure supplied thereto;

a regulator configured to regulate the control pressure in accordance with a front-rear differential pressure of the control valve;

a fixed capacity second pump configured to be driven by a drive source that drives the first pump;

a resistor provided in a pump passage through which the working fluid discharged from the second pump is led;

a control actuator configured to operate in accordance with a front-rear differential pressure of the resistor so as to drive the regulator to reduce the control pressure in response to an increase in the front-rear differential pressure of the resistor;

an auxiliary passage configured to lead an auxiliary pressure to the control actuator, the auxiliary pressure acting on the control actuator against either an upstream side pressure or a downstream side pressure of the resistor;

a switch valve configured to switch between a state in which the auxiliary pressure is supplied to the control actuator through the auxiliary passage and a state in which the auxiliary pressure is shut off; and a controller configured to switch the switch valve and modify a rotation speed of the drive source in accordance with operation input from an operator, wherein the control actuator is configured such that the auxiliary pressure acts on the control actuator against the upstream side pressure of the resistor, and the controller is configured to increase a discharge capacity of the first pump by switching the switch valve so as to shut off the auxiliary passage and reduce the rotation speed of the drive source in accordance with operation input from the operator.

8. A pump device for supplying a working fluid to a drive actuator for driving a drive subject through a control valve, comprising:

a variable capacity first pump configured to supply the working fluid to the drive actuator, the first pump having a discharge capacity that varies in accordance with a tilt angle of a swash plate;

a tilt actuator configured to control the tilt angle of the swash plate of the first pump in accordance with a control pressure supplied thereto;

a regulator configured to regulate the control pressure in accordance with a front-rear differential pressure of the control valve;

a fixed capacity second pump configured to be driven by a drive source that drives the first pump;

a resistor provided in a pump passage through which the working fluid discharged from the second pump is led;

a control actuator configured to operate in accordance with a front-rear differential pressure of the resistor so as to drive the regulator to reduce the control pressure in response to an increase in the second differential pressure of the resistor;

an auxiliary passage configured to lead an auxiliary pressure to the control actuator, the auxiliary pressure acting on the control actuator against either an upstream side pressure or a downstream side pressure of the resistor; and a switch valve configured to switch between a state in which the auxiliary pressure is supplied to the control actuator through the auxiliary passage and a state in which the auxiliary pressure is shut off, wherein the resistor comprises a fixed throttle configured to apply resistance to a flow of working fluid discharged from the second pump, and a relief valve provided in parallel with the fixed throttle and configured to open when the upstream side pressure of the resistor exceeds a predetermined value.

* * * * *